US007320299B2

(12) United States Patent
Eavenson, Sr. et al.

(10) Patent No.: US 7,320,299 B2
(45) Date of Patent: Jan. 22, 2008

(54) COOLING SYSTEM FOR LIQUID-COOLED MACHINES

(75) Inventors: Jimmy N. Eavenson, Sr., Aurora, OH (US); Peter Buchanan, Hudson, OH (US)

(73) Assignee: Commercial Turf Products, Ltd., Streetsboro, OH (US)

( * ) Notice: Subject to any disclaimer, the term of this patent is extended or adjusted under 35 U.S.C. 154(b) by 0 days.

(21) Appl. No.: 11/654,334

(22) Filed: Jan. 17, 2007

(65) Prior Publication Data

US 2007/0169989 A1 Jul. 26, 2007

Related U.S. Application Data

(60) Provisional application No. 60/761,022, filed on Jan. 20, 2006.

(51) Int. Cl.
*F02B 77/13* (2006.01)
*F01P 7/10* (2006.01)
*F02M 35/02* (2006.01)

(52) U.S. Cl. ..... 123/41.49; 181/204

(58) Field of Classification Search ..... 123/41.11, 123/41.3, 41.49, 41.55, 41.56, 41.57, 41.63, 123/41.65; 180/68.4; 165/51; 181/240, 181/204, 212, 227–228; 60/320
See application file for complete search history.

(56) References Cited

U.S. PATENT DOCUMENTS 4,076,099 A 2/1978 Proksch
4,265,332 A 5/1981 Presnall et al.
4,590,891 A * 5/1986 Fujikawa et al. ..... 123/41.11
4,741,411 A * 5/1988 Stricker ..... 181/283
4,766,983 A * 8/1988 Tamba et al. ..... 181/240
4,825,815 A 5/1989 Turner
4,862,981 A * 9/1989 Fujikawa et al. ..... 180/68.4
4,891,940 A 1/1990 Tamba et al.
5,078,223 A 1/1992 Ishiwatari et al.
5,199,521 A 4/1993 Samejima et al.
5,228,530 A 7/1993 Tsuchihashi
5,284,115 A 2/1994 Imanishi et al.
5,689,953 A 11/1997 Yamashita et al.
5,947,219 A * 9/1999 Peter et al. ..... 180/68.1
5,960,899 A * 10/1999 Roach ..... 180/68.4
6,026,768 A 2/2000 Spitler et al.
6,092,616 A 7/2000 Burris et al.
6,105,349 A 8/2000 Busboom et al.

(Continued)

*Primary Examiner*—Hai Huynh
(74) *Attorney, Agent, or Firm*—Wegman, Hessler & Vanderburg

(57) ABSTRACT

A cooling system for an engine of a lawnmower. The engine has a muffler through which exhaust gases exit the engine and is cooled by a liquid coolant. The cooling system includes a heat exchanger operatively connected to the engine to receive the liquid coolant from the engine at a first temperature and return the liquid coolant to the engine at a lower temperature. A fan mounted above the heat exchanger is operable to draw or pull an air flow in a standard direction upward through the heat exchanger. The heat exchanger and fan are oriented in an inclined orientation such that the air flow is directed upward and away from the operator station of the lawnmower. The cooling system also has a generally tubular baffle surrounding the muffler at least partially isolating the engine from heat radiating from the muffler. The baffle is configured such that exhaust leaving the muffler causes air to be inducted into the areas between the muffler and the baffle by an aspiration effect created by the exiting exhaust gases.

11 Claims, 5 Drawing Sheets

U.S. PATENT DOCUMENTS 6,321,830 B1 11/2001 Steinmann
6,435,264 B1 8/2002 Konno et al.
6,491,502 B2 12/2002 Hunt
6,523,520 B1 2/2003 Chatterjea
6,622,806 B1 9/2003 Matsuura
6,634,448 B2 10/2003 Bland
6,655,486 B2 12/2003 Oshikawa et al.
6,880,656 B2 4/2005 Pfusterschmid et al.
7,051,786 B2 * 5/2006 Vuk ..... 165/41

* cited by examiner

COOLING SYSTEM FOR LIQUID-COOLED MACHINES

CROSS-REFERENCE TO RELATED APPLICATION

This application claims the priority benefit of U.S. Provisional Patent Application No. 60/761,022 filed Jan. 20, 2006.

BACKGROUND OF THE INVENTION

1. Field of Invention

This invention relates to the field of lawnmowers having liquid-cooled engines, and more particularly, to an improved cooling system for such engines.

2. Description of Related Art

It is known in the art to provide a riding lawnmower with a water cooled engine having a heat exchanger to transfer the heat away from the circulating cooling water. In conventional liquid cooled engines, output pulleys drive one or more belts, which drive pumps, motors and/or other compressors to move the coolant through the engine. In one design, a "push" type fan is mounted on the output pulley spindle of one of the pulleys adjacent the heat exchanger. Air is pushed through the core area of the heat exchanger by the fan.

Other arrangements have been configured, such as with cooling fans that are mounted underneath the heat exchanger so that air is drawn or "pulled" downward through the heat exchanger. A consequence of moving the air through the heat exchanger with a fan in a riding lawnmower is a build up of grass clippings and related debris on the intake side of the heat exchanger. For example, when directing air downward through the heat exchanger, dust, debris, and other materials tend to accumulate on the upper (inlet) areas of the heat exchanger, thereby reducing its efficiency and performance. Any debris not cleared from the intake side of the heat exchanger decreases the air flow volume that can be drawn across the heat exchanger, thereby decreasing the heat exchanger's heat transfer rate. In short, the engine is caused to run hotter, which lowers the engine's efficiency and longevity. Also, the aforementioned systems typically do not include nor address the exhaust systems of the engine, which generate considerable amounts of heat that must also be removed from the machine.

It therefore would be desirable to have an improved cooling system for water-cooled riding lawnmowers, tractors and similar vehicles.

SUMMARY OF THE INVENTION

In one embodiment, the invention provides an improved cooling system for a lawnmower. The lawnmower has a chassis that forms an operator station, such as with a seat mounted on the chassis. The lawnmower also includes ground engaging wheels rotatably mounted on the chassis, and an engine operatively connected to the ground engaging wheels to propel the lawnmower. The engine has a muffler through which exhaust gases exit the engine and is cooled by a liquid coolant. The cooling system of the lawnmower includes a heat exchanger operatively connected to the engine to receive the liquid coolant from the engine at a first temperature and to return the liquid coolant to the engine at a lower temperature. A fan is mounted above the heat exchanger and is operable to draw or pull an air flow in a standard direction upward through the heat exchanger. The heat exchanger and fan are oriented in an inclined orientation such that the air flow is directed upward and away from the operator station of the lawnmower. The cooling system also has a generally tubular baffle surrounding the muffler at least partially isolating the engine from heat radiating from the muffler. The baffle is configured such that exhaust leaving the muffler causes air to be inducted into the areas between the muffler and the baffle by an aspiration effect created by the exiting exhaust gases.

These and other features and advantages of this invention are described in, or are apparent from, the following detailed description of various exemplary embodiments of the systems and methods according to this invention.

BRIEF DESCRIPTION OF THE DRAWINGS

The structure, operation, and advantages of the presently disclosed embodiment of the invention will become apparent when consideration of the following description is taken in conjunction with the accompanying drawings wherein.

Corresponding reference characters indicate corresponding parts throughout the views of the drawings.

DETAILED DESCRIPTION OF EXEMPLARY EMBODIMENTS

The invention will now be described in the following detailed description with reference to the drawings, wherein preferred embodiments are described in detail to enable practice of the invention. Although the invention is described with reference to these specific preferred embodiments, it will be understood that the invention is not limited to these preferred embodiments. But to the contrary, the invention includes numerous alternatives, modifications and equivalents as will become apparent from consideration of the following detailed description.

Figure 1:
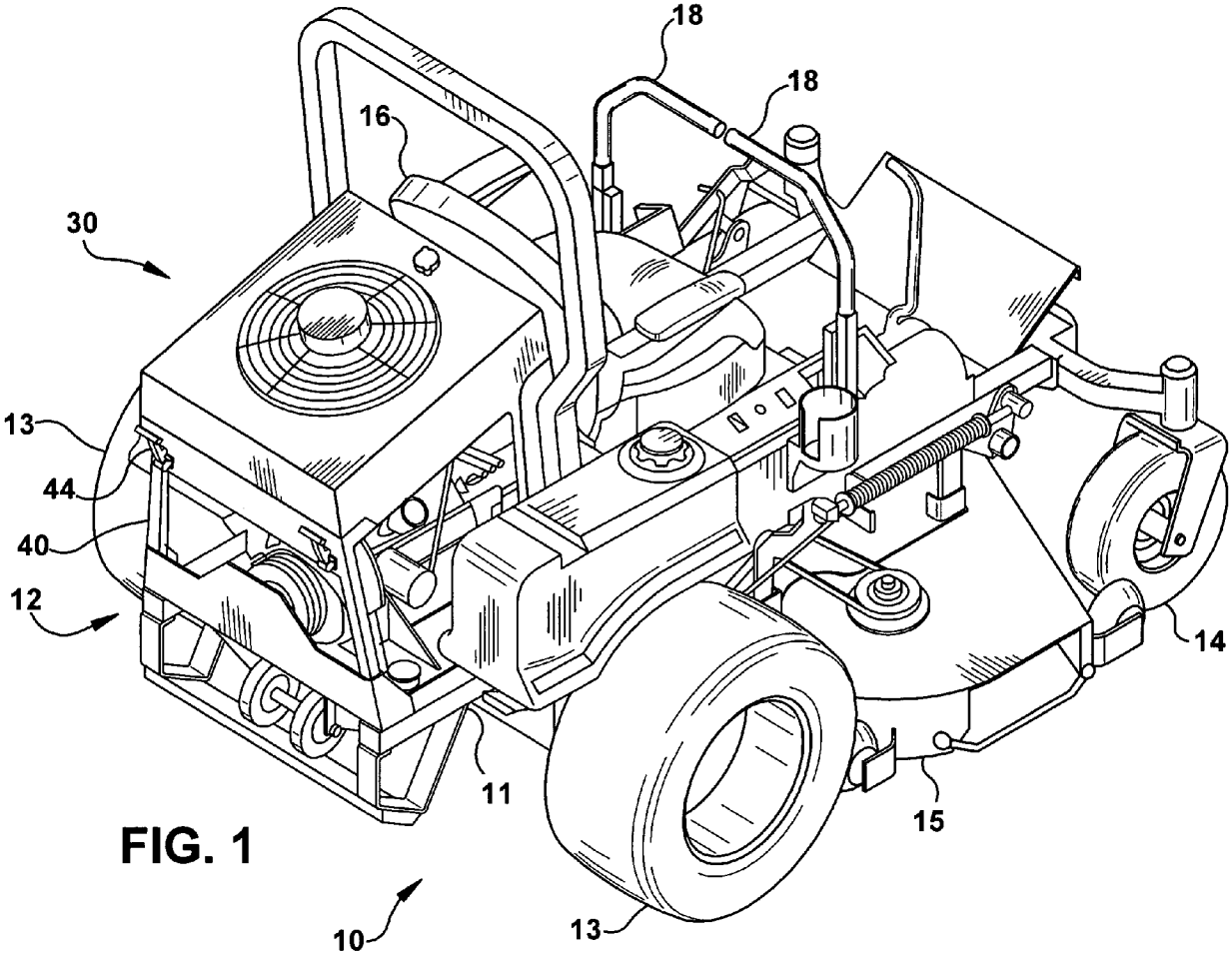
FIG. 1 is a perspective view of a lawnmower embodying the invention.

Referring now to FIG. 1, a riding lawnmower 10 of the type able to turn with a turn radius that is substantially zero (referred to herein as a zero turn mower or "ZTM") is illustrated. The mower 10 is built on a frame or chassis 11 which supports a power source such as an engine 12, a pair of drive wheels 13, a pair of caster mounted follower wheels 14, and a conventional multi-blade deck 15. In use, the drive wheels 13 are used to move the riding mower 10 and the castor wheels 14 support the front end of the riding mower 10. The riding mower 10 also includes a seat 16 or like structure forming an operator station for the driver of the mower and a pair of direction and speed control levers 18 that are used to control the direction and the speed of revolution of the drive wheels 13 to thereby control the speed and direction of the mower 10. The control levers 18 are rotatably attached to the chassis 11 and move forward and aft from a neutral position to achieve variable speed and steering of the mower 10. The description above refers to a ZTM, however, it is to be understood that the invention set forth below may also be used in other lawnmowers, tractors, and similar vehicles.

Figure 2:
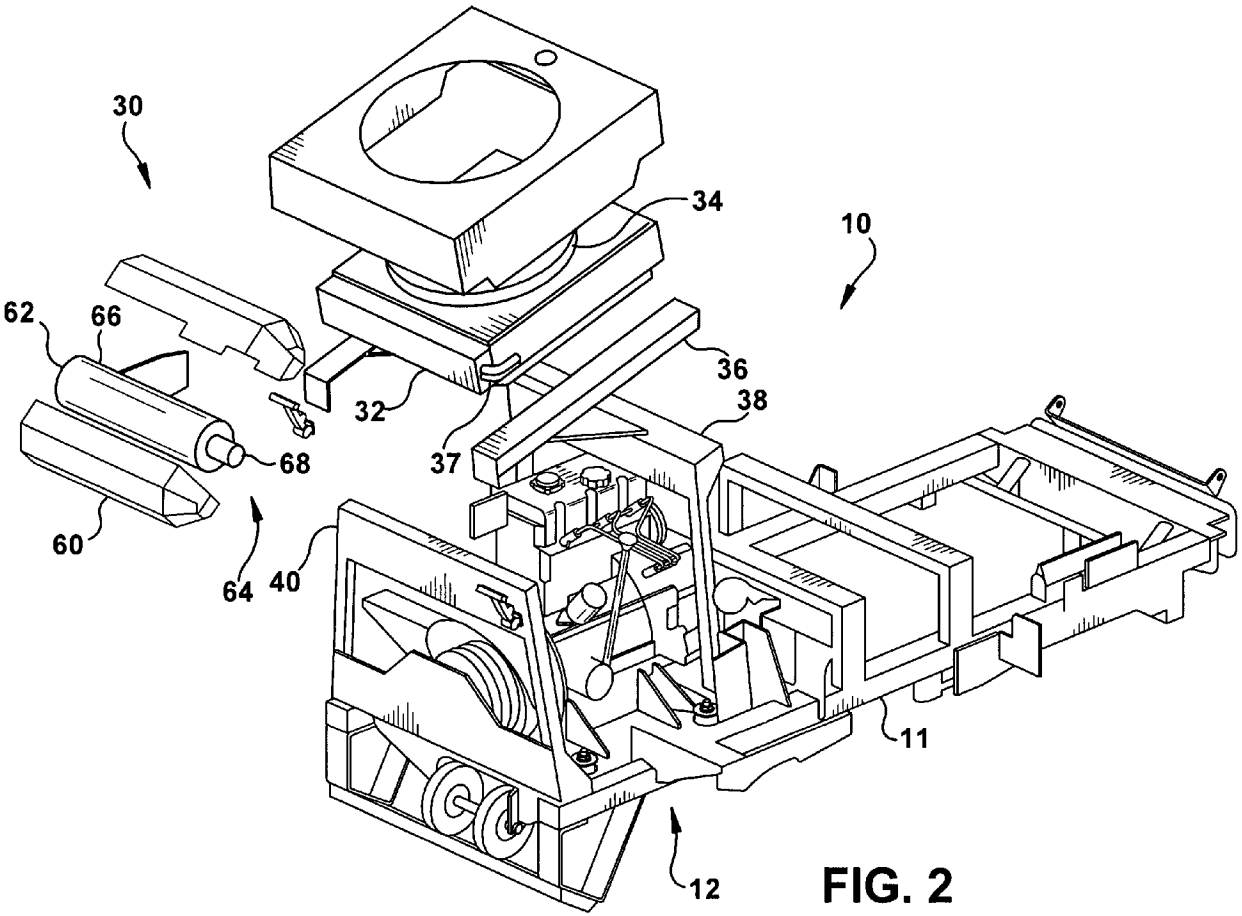
FIG. 2 is an exploded perspective view of the lawnmower of FIG. 1 illustrating the engine cooling system.

The lawnmower 10 includes an engine cooling system 30 in accordance with the invention. Desirably, the engine 12 is liquid cooled and, as such, the cooling system 30 employs a heat exchanger 32, a cooling fan 34 and associated components that are mounted via a supporting structure above the engine 12 and behind operator seat 16 as best seen in FIG. 2. Desirably, the liquid cooling medium is water, however other known liquid coolants may also be used. The fan 34 is an electrically or hydraulically driven "pull" (suction) type fan mounted on the upper side of the heat exchanger 32. This arrangement provides for a shorter overall machine length (when compared to non-remote mounted systems) and provides for convection heat from the engine 12 and associated components to be drawn up through the heat exchanger 32 and fan 34 and be rejected along with the coolant load from the engine 12.

The heat exchanger 32 is sized to accommodate the cooling capacity recommended for the engine 12. The heat exchanger 32 is stabilized by connecting it to a heat exchanger mount 36 by any appropriate means such as nuts and bolts (not shown). The heat exchanger 32 includes input and output ports 37 which connect with the water-based cooling system of engine 12. The heat exchanger 32 is also designed to connect with and cool the circulating hydraulic fluid of the mower's hydraulic drive system and includes oil input and output ports (not shown).

Figure 3:
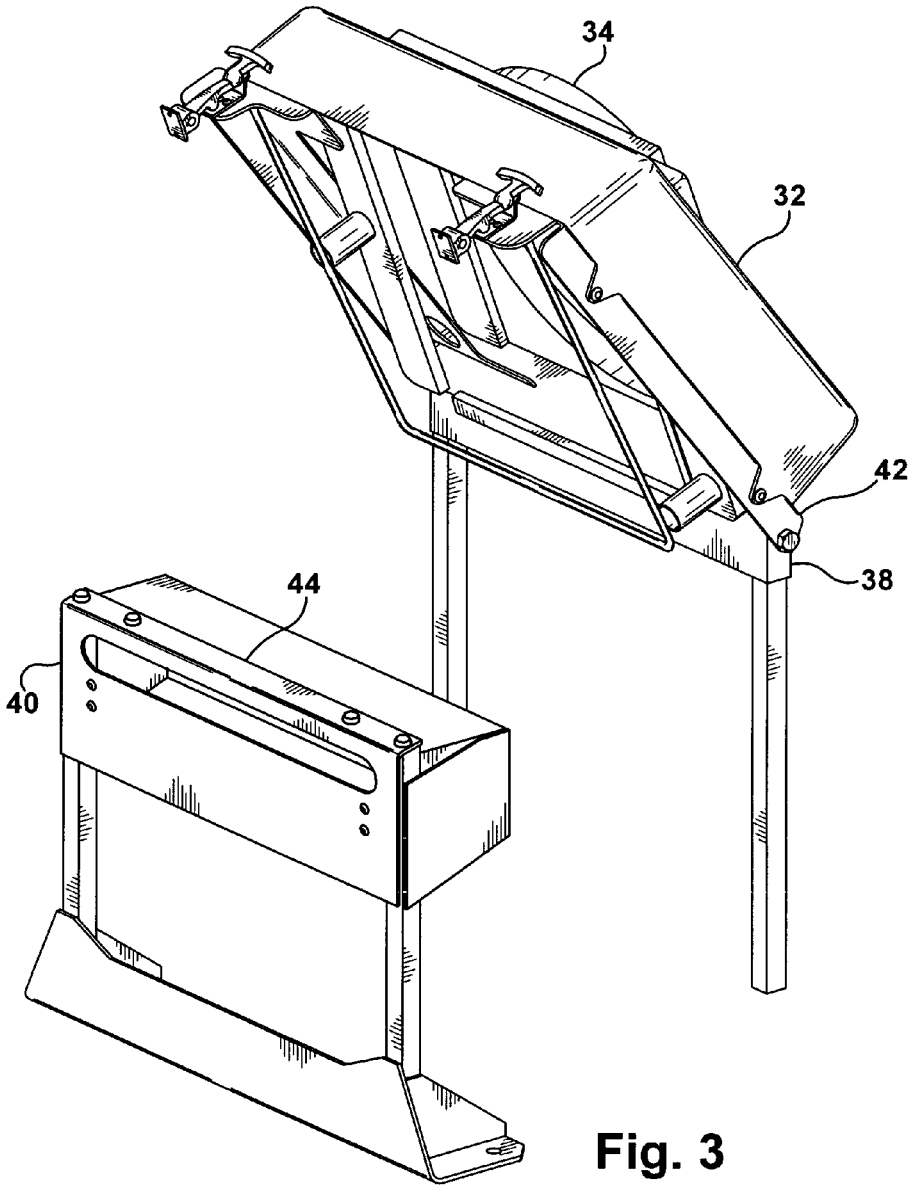
FIG. 3 is a perspective view of a portion of the engine cooling system in a pivoted position.

The mount 36 is connected to the mower frame 11 via front frame member 38 and rear frame member 40 that serve as a support structure for the heat exchanger 32 and fan 34. The heat exchanger 32 and fan 34 are configured and positioned in an inclined orientation such that heated air is directed upward and away from the seat 16 and operator station of the lawnmower 10. This mounting configuration enhances the natural convection process and therefore provides an improved solution for cooling. As best seen in FIG. 3, the mount 36 and frame members 38, 40 comprise a pivotable mounting means 42 on one end and a latching means 44 on the other. In one embodiment, the heat exchanger mount 36 includes a pair of hinge sleeves located on the rear, bottom edge of mount 36. Hinge pins extend through the hinge sleeves such that the mount 36 is hingedly connected to the frame 11. By pivot mounting the heat exchanger 32 and fan 34 onto the frame 11, the heat exchanger 32 can be repositioned (e.g., rotated on its pivot axis) to provide access to the lower side of the heat exchanger 32 for inspection or cleaning components of the engine 12.

The fan 34 can be an appropriate electrically powered fan commercially available from most lawnmower parts suppliers. The fan 34 is desirably configured with a control system (not shown) that is energized when the coolant reaches a designated temperature, and is de-energized when a lower designated temperature is reached. Also included is a momentary directional reversal of the fan 34 to a "push" air flow direction so as to create an air "pulse" to dislodge dust, debris, etc., that may have accumulated on the lower side of the heat exchanger 32. The electrical components and connections to permit fan 34 to be run in the standard direction and to be reversed automatically and/or manually, at mower startup and/or during normal operation, and/or for as long as the switch is activated or for a preset time (a blast period) are not disclosed herein and are believed to be within the knowledge of one skilled in the art.

The fan 34 is mounted above the heat exchanger by appropriate means, such as screws, in a position to draw or pull airflow through a central fan opening 48 in the heat exchanger 32. The fan 34 draws air upwardly through the engine and into the heat exchanger 32 and then out through the central fan opening 48 away from the heat exchanger and the operator seat 16.

Figure 4:
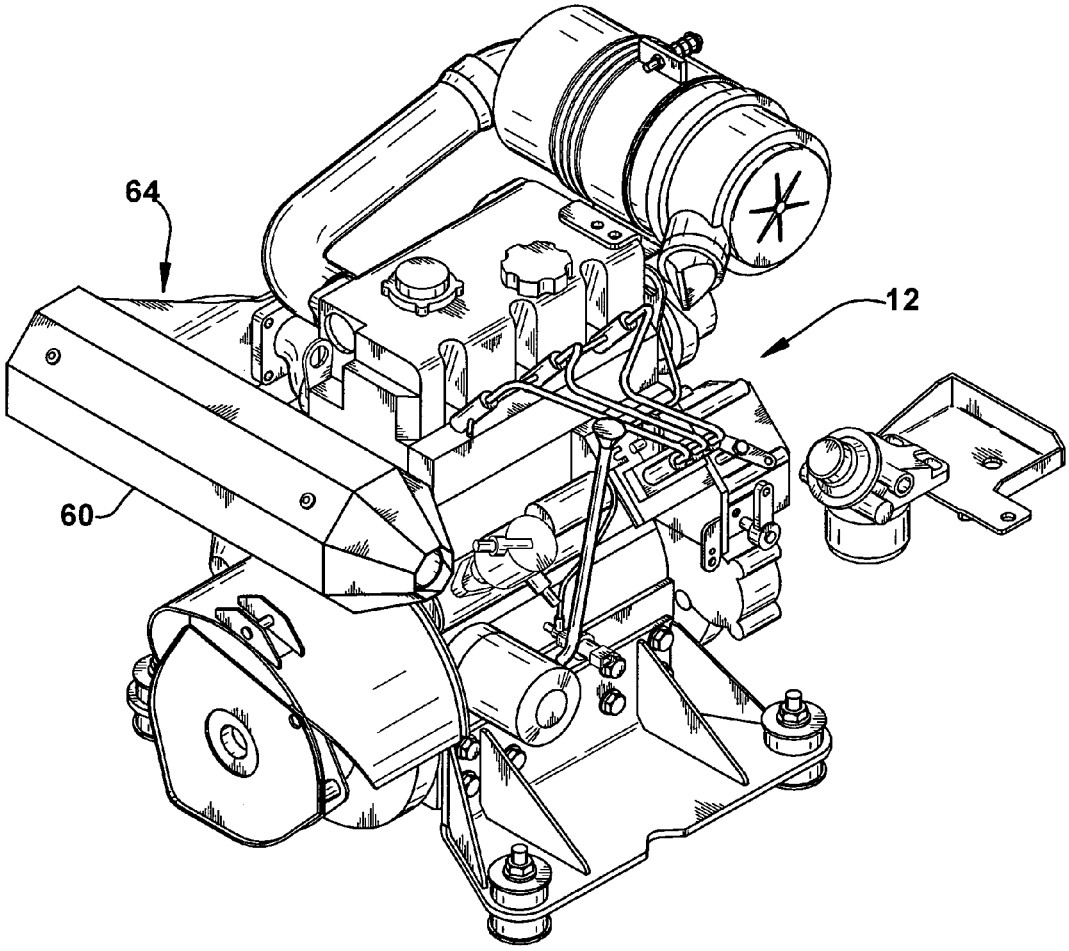
FIG. 4 is a perspective view of the shielded muffler of the engine cooling system of FIG. 2.

Referring now to FIGS. 2 and 4, the engine cooling system 30 also contains a generally tubular baffle or heat shield 60 surrounding a muffler or silencer 62 of an exhaust system 64 of the engine 12. The baffle 60 partially isolates the engine 12 from the heat radiating from the muffler 62 in order to reduce the coolant load that would normally pass through the heat exchanger 32. The muffler 62 is of standard internal design and has a body 66 connected to the exhaust manifold (not shown) of the engine 12. A short, tubular exhaust pipe 68 on the discharge end of the muffler body 66 directs the exhaust gases out of the muffler 62.

Figure 5:
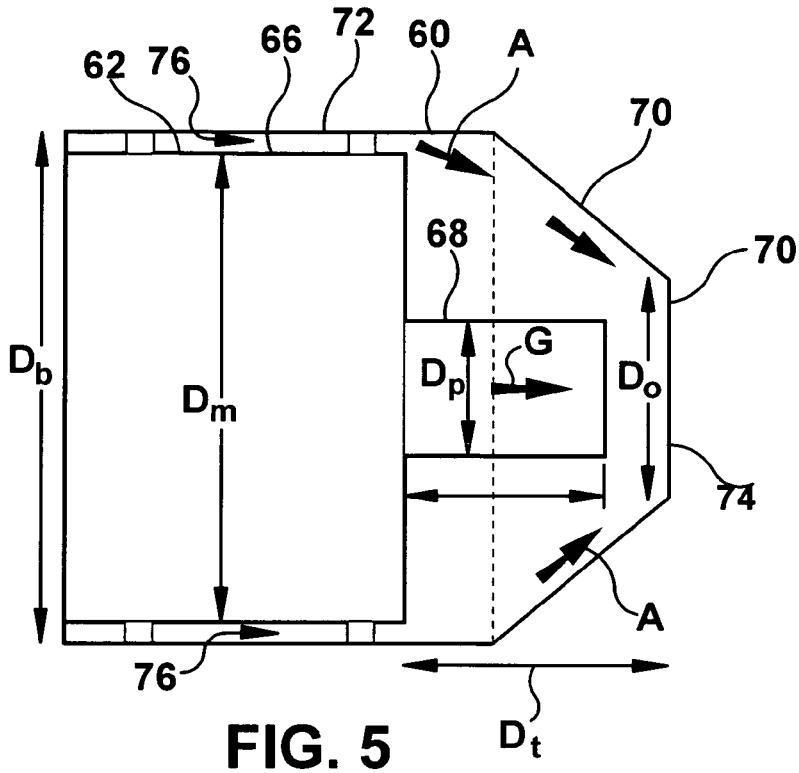
FIG. 5 is a side view of the shielded muffler of the engine cooling system of FIG. 2.

As best seen in FIG. 5, the baffle 60 is provided and so configured for the exhaust system that air is inducted or aspirated into the areas between the muffler 62 and the baffle 60, by an aspiration effect created by the exiting exhaust gasses. The baffle 60 has an outer end portion that defines a venturi tube 70. The baffle 60 includes a large diameter body 72 connected to the venturi tube 70 which has a small diameter portion 74. The baffle 60 is concentric with and surrounds the body 66 of the muffler 62 to define an annular air passage 76 therebetween. The tubular exhaust pipe 68 on the discharge end of the muffler body 66 directs the exhaust gases into the venturi tube 70.

During operation, the engine exhaust gases, indicated by arrow G, are directed through the muffler 62 and into the venturi tube 70 of the baffle 60. The pressure of the hot exhaust gases G discharging from the exhaust pipe 68 is reduced as the gases enter the small diameter portion 74 of the venturi tube 70 thus resulting in a substantial increase in velocity of the exhaust gases G as they leave the venturi tube 70 and enter the atmosphere externally of the baffle 60. This high velocity exhaust gas G creates a substantial flow of cooling air, indicated by arrows A, through the annular passage 76 between the muffler 62 and a tubular baffle 60, which air mingles with and cools the exhaust gas G when in the venturi tube 70.

Desirably, the baffle 60 has a multi-sided shape, such as octagonal, hexagonal, or the like. Without being constrained to one specific explanation, it is believed that the multi-sided shape (i.e., octagonal) of the baffle 60 greatly enhances cooling effectiveness by providing increased airflow in the corner sectors C formed by the multi-sided shape verses the flat sectors F. The increased airflow results in the corner sectors C enhances the heat transfer through the boundary layers. This baffle 60 reduces the coolant load that would normally be radiated or transferred to the surrounding environment. That coolant load could be passed into and through the heat exchanger 32 of the engine cooling system 30 requiring it to be designed with increased or excessive capacity.

Figure 6:
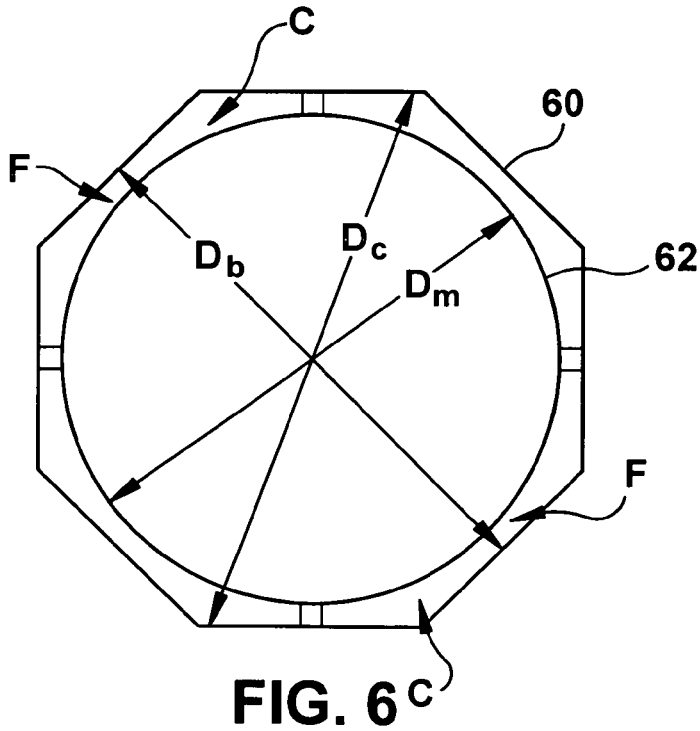
FIG. 6 is an end view of the shielded muffler of the engine cooling system of FIG. 2.

Referring now to FIGS. 5 and 6, one preferred embodiment of the baffle 60 will be more fully described. The distance $D_b$ across the shield flats F of the baffle 60 is desirably about 120% to about 130% of the diameter $D_m$ of the muffler 62. The distance $D_o$ across shield flats at outlet 74 of the venturi tube 70 is desirably about 175% to about 225% of the diameter $D_p$ of the exhaust pipe 68. The distance D, from muffler 60 to the baffle outlet 74 is desirably equal to length $L_p$ of exhaust pipe 68 plus about 80% to about 120% the exhaust pipe diameter $D_p$ While this invention has been described in conjunction with the specific embodiments described above, it is evident that many alternatives, combinations, modifications and variations are apparent to those skilled in the art. Accordingly, the preferred embodiments of this invention, as set forth above are intended to be illustrative only, and not in a limiting sense. Various changes can be made without departing from the spirit and scope of this invention.

What is claimed is:

1. A lawnmower comprising:

a chassis;

an operator station on said chassis;

a plurality of ground engaging wheels rotatably mounted on said chassis;

an engine mounted on the chassis and operatively connected to drive said ground engaging wheels, said engine having a muffler through which exhaust gases exit said engine and said engine being cooled by a liquid coolant;

an engine cooling system comprising:

a heat exchanger operatively connected to said engine to receive said liquid coolant from said engine at a first temperature and return said liquid coolant to the engine at a lower temperature;

a fan mounted above the heat exchanger and operable to draw an air flow in a standard upward direction through said heat exchanger, wherein said heat exchanger and fan are oriented in an inclined orientation such that the air flow is directed upward and away from the operator of the lawnmower and wherein the fan is operable to push or blow air in a standard downward direction through said heat exchanger; and a generally tubular baffle surrounding the muffler at least partially isolating the engine from heat radiating from the muffler, wherein the baffle is configured such that exhaust gases leaving the muffler causes air to be inducted into the areas between the muffler and the baffle by an aspiration effect created by the exiting exhaust gases.

2. The lawnmower of claim 1 wherein the baffle has an outer end portion that defines a venturi tube.

3. The lawnmower of claim 2 wherein the baffle is concentric with and surrounds the muffler to define an annular air passage therebetween and an exhaust pipe on a discharge end of the muffler directs the exhaust gases into the venturi tube.

4. The lawnmower of claim 3 wherein the baffle has a multi-sided shape.

5. The lawnmower of claim 4 wherein the baffle has an octagonal or hexagonal shape.

6. The lawnmower of claim 4 wherein the distance $D_b$ across shield flats of the baffle is about 120% to about 130% of the diameter $D_b$ of the muffler, the distance $D_o$ across shield flats at an outlet of the venturi tube is about 175% to about 225% of the diameter $D_p$ of the exhaust pipe and the distance $D_t$ from the muffler to the baffle outlet is equal to the length $L_p$ of the exhaust pipe plus about 80% to about 120% the exhaust pipe diameter $D_p$.

7. The lawnmower of claim 1 wherein the heat exchanger and fan are mounted onto the chassis such that they can be pivoted to provide access to the lower side of the heat exchanger.

8. The lawnmower of claim 1 wherein the operator station is formed by a seat mounted on the chassis.

9. A method for increasing cooling of a lawnmower engine cooling system, the lawnmower comprising a chassis, an operator station on said chassis, an engine mounted on the chassis, the engine cooling system comprising a heat exchanger operatively connected to said engine, a fan mounted above the heat exchanger and operable to draw an air flow in a standard upward direction through said heat exchanger, a generally tubular baffle surrounding the muffler at least partially isolating the engine from heat radiating from the muffler, wherein the baffle is configured such that exhaust gases leaving the muffler cause air to be conducted into the areas between the muffler and the baffle by an aspiration effect created by the exiting exhaust gases, said method comprising the steps of:

pivot mounting said heat exchanger and fan onto said chassis;

orienting said heat exchanger and fan in an inclined position so as to direct said exhaust gases upward and away from said operator station;

wherein the pivot mounting step facilitates rotating of said heat exchanger about its pivot axis to provide access to the lower side of the heat exchanger and said engine.

10. The method as recited in claim 9, wherein the pivot mounting and orienting steps function to enhance the natural convection process of heat from the engine through the heat exchanger.

11. A lawnmower comprising:

a chassis;

an operator station on said chassis;

a plurality of ground engaging wheels rotatably mounted on said chassis;

an engine mounted on the chassis and operatively connected to drive said ground engaging wheels, said engine having a muffler through which exhaust gases exit said engine and said engine being cooled by a liquid coolant;

an engine cooling system comprising:

a heat exchanger operatively connected to said engine to receive said liquid coolant from said engine at a first temperature and return said liquid coolant to the engine at a lower temperature;

a fan mounted above the heat exchanger and operable to draw an air flow in a standard upward direction through said heat exchanger, wherein said heat exchanger and fan are oriented in an inclined orientation such that the air flow is directed upward and away from the operator of the lawnmower; and a multi-sided baffle surrounding the muffler at least partially isolating the engine from heat radiating from the muffler, wherein the baffle is configured such that exhaust gases leaving the muffler causes air to be inducted into the areas between the muffler and the baffle by an aspiration effect created by the exiting exhaust gases.

* * * * *

UNITED STATES PATENT AND TRADEMARK OFFICE

CERTIFICATE OF CORRECTION

PATENT NO. : 7,320,299 B2
APPLICATION NO. : 11/654334
DATED : January 22, 2008
INVENTOR(S) : Jimmy N. Eavenson, Sr. and Peter Buchanan It is certified that error appears in the above-identified patent and that said Letters Patent is hereby corrected as shown below:

Column 5, line 54, delete "$D_b$" and insert "$D_m$".

Signed and Sealed this

Thirteenth Day of May, 2008

JON W. DUDAS
*Director of the United States Patent and Trademark Office*